US006566606B1

(12) United States Patent
Hazy et al.

(10) Patent No.: US 6,566,606 B1
(45) Date of Patent: May 20, 2003

(54) SHARED SHEATH DIGITAL TRANSPORT TERMINATION CABLE

(75) Inventors: Lewis E. Hazy, Sidney, NE (US); Larry D. Alexander, Sidney, NE (US); Timothy N. Berelsman, Delphos, OH (US); Frederick W. Johnston, III, Dalton, NE (US); Mark White, Sidney, NE (US); Jeffrey J. Stutzman, Sidney, NE (US)

(73) Assignee: Krone, Inc., Centennial, CO (US)

( * ) Notice: Subject to any disclaimer, the term of this patent is extended or adjusted under 35 U.S.C. 154(b) by 0 days.

(21) Appl. No.: 09/386,878

(22) Filed: Aug. 31, 1999

(51) Int. Cl.[7] ..... H01B 11/00
(52) U.S. Cl. ..... 174/113 R; 174/36
(58) Field of Search ..... 174/36, 107, 108, 174/109, 113 R

(56) References Cited

U.S. PATENT DOCUMENTS 3,576,939 A * 5/1971 Ziemek ..... 174/36 X
3,643,007 A * 2/1972 Roberts et al. ..... 174/36 X
4,096,346 A * 6/1978 Stine et al. ..... 174/36
4,150,249 A * 4/1979 Pedersen ..... 174/36
4,510,346 A 4/1985 Bursh, Jr. et al.
4,691,081 A * 9/1987 Gupta et al. ..... 174/36 X
5,008,490 A 4/1991 Strauss et al.
5,061,827 A * 10/1991 Grabbe ..... 174/75 C
5,107,076 A * 4/1992 Bullock et al. ..... 174/36 X
5,216,202 A 6/1993 Yoshida et al.
5,473,117 A 12/1995 Morgan et al.
5,530,203 A 6/1996 Adams et al.
5,767,442 A 6/1998 Eisenberg et al.
5,834,699 A 11/1998 Buck et al.
5,956,445 A * 9/1999 Deitz, Sr. et al. ..... 385/100
6,010,788 A * 1/2000 Kebabjian et al. ..... 174/109 X

* cited by examiner

*Primary Examiner*—Chau N. Nguyen
(74) *Attorney, Agent, or Firm*—Rader, Fishman & Grauer PLLC

(57) ABSTRACT

A telecommunications cable includes multiple binder units. Each binder unit includes a predetermined number of twisted pairs enclosed by a binder unit wrap. A foil free edge tape is applied over the top of the unit wrap with the foil facing inwardly. A drain wire is pulled between the foil and the unit wrap. A preselected number of binder units are enclosed by an overall core wrap, and a shield is applied over the top of the overall core wrap such that the shield surface faces inwardly for improved termination methods. An overall drain wire is placed between the overall core and overall shield. The entire cable may be enclosed by a jacket or sheath.

10 Claims, 4 Drawing Sheets

SHARED SHEATH DIGITAL TRANSPORT TERMINATION CABLE

FIELD OF THE INVENTION

The present invention relates to a cable made of twisted wire pairs, and more particularly, to a cable made of twisted wire pairs that is suitable for use in high-speed data communication applications.

BACKGROUND OF THE INVENTION

Twisted pair telecommunication wires are bundled together in large cables. Typically, 50 or more pairs of wire are included in a typical cable configuration near its termination point. However, cables coming out of a central telecommunications location may have hundreds or even thousands of pairs bundled together. In operation, each twisted pair within the cable is utilized for transmitting data as well as for furnishing direct current (DC) power to remote equipment. With signal multiplexing, a single twisted pair may service multiple data signals and multiple end users, reducing the number of individual pairs required for a desired level of service and reducing the distance between an access point and a final subscriber.

Recently, demands upon telecommunication systems have greatly increased. With the explosive growth of the Internet, consumers and telecommunication companies alike are seeking new methods for high speed data transmission. In particular, telecommunication companies and other entities are developing methods for supporting digital communication circuits at increased speed and/or distances than have existed in the past. For example, new methods for supporting digital communication circuits at increased speed and/or distance include, but are not limited to, DS1/1C/2, ADSL, SDSL, HDSL, and VDSL. In addition, telecommunication companies and other entities are developing these new methods for use over the existing telephone wiring infrastructure, which is generally composed of twisted pair wires bundled as cables strung over relatively long distances.

In general, wire pairs are twisted to minimize the interference of signals from one pair to another caused by radiation or capacitive coupling between the pairs. When a signal is present on a twisted pair, a state known as "active," the twisted pair naturally creates an electromagnetic field around it. The electromagnetic field thus generated may induce a signal in other twisted pairs located within the electromagnetic field. Additionally, a field generated by one active twisted pair can interfere with the operation of other active pairs located in close proximity to the first pair. As a result, signals transmitted in one pair may generate "noise" within adjoining pairs, thereby degrading or attenuating the signal in the adjoining pairs. This coupling, known as "crosstalk," worsens as data transmission frequencies and data transmission length increase.

With the emerging deployment of the various high speed digital transport systems and services, the shortcomings of the existing and deployed twisted pair communications cables are quickly being apparent. Emerging methods of supporting digital communication circuits, described above, rely upon using increased data transmission frequencies over long distances. For example, normal voice transmissions transmitted over telephone wires occur in a frequency range from greater than 0 to 4 kHz, while DSL applications typically transmit in a frequency range from greater than 0 to about 100 kHz over distances between 12,000 and 18,000 feet. As can be appreciated, emerging digital communications methods are highly prone to error due to crosstalk between pairs within the cable, between adjoining cables, and from outside interference, especially at the point where the incoming signal is interfaced to transport equipment such as a modem.

Typically, existing twisted pair cables attempt to isolate outside interference and crosstalk by using a common shield within the cable and by grounding the shield at a termination point. Alternatively, if multiple shields are used, existing cables fail to isolate various shields within a cable, such that the multiple shields within a cable electrically communicate with each other, especially after prolonged use. Specifically, if a telecommunications cable includes an overall shield surrounding a unit shield, the overall shield may electrically communicate with the unit shield, or else electrical interaction may occur due to shield shorts for pinholes in any insulation. Moreover, typical telecommunications cables currently in use terminate the overall shield by drawing out a drain wire and simply clamping it to ground. Unfortunately, grounding the drain wire usually causes it to act as an antenna that draws interference into the cable from outside sources.

SUMMARY OF THE INVENTION

A cable for supporting digital communication circuits and increased speed and/or distances is disclosed. The cable design employs multiple binder units, each binder unit comprising a predetermined number of twisted pairs. Each binder unit is enclosed by a binder core wrap. The binder core wrap is enclosed by a foil free edge tape applied with the foil facing inwardly and a drain wire pulled between the foil and the core wrap. A preselected number of binder units further comprise a cable. The preselected number of binder units are enclosed by an overall core wrap, and a unit shield is applied over the top of the overall core wrap such that the shield surface faces inwardly for improved termination to ground. An overall drain wire is placed between the overall core wrap and overall shield. Finally, the entire cable may be enclosed by a jacket or sheath.

In the cable of the present invention, the overall shield is isolated from the unit shields, and each shield may be terminated to ground independently of the other. In this way, the inner binder units are isolated from outside interference, e.g., from other adjacent cables. The shields are also isolated from contacting each other or from contacting individual wires or wire pairs, by the overall core wrap, thereby preventing shorts or signal loss through pinholes in the twisted pair insulation.

Moreover, both the overall shield and the unit shield are applied with the foil side inwardly oriented. This arrangement allows the foil to be folded back over the cable and the binder unit, respectively, and terminated using a simple grounding clamp, rather than by grounding the drain wire as is currently the practice. By clamping the shields instead of the drain wire, shielding performance is enhanced because the drain wires are not able to act as an antenna and draw interference into the cable.

By separating the twisted pair wires into manageably sized binder units, convenience and efficiency of use is enhanced. For example, separate digital services may be provided through each of the binder units based upon the frequency spectrum within which they operate. Alternatively, one binder unit may be used as a "send" unit, while an adjacent binder unit may be designated the "receive" units. By separating "send" and "receive" functions between binder units, rather than simply between twisted pairs within a single unit, local crosstalk is minimized, leading to increased transmission distances.

BRIEF DESCRIPTION OF THE DRAWINGS

The features and advantages of the present invention will be apparent to one of ordinary skill and art from the detailed description of the invention that follows and from the accompanying drawings, wherein.

DETAILED DESCRIPTION OF PREFERRED EMBODIMENTS

Figure 1:
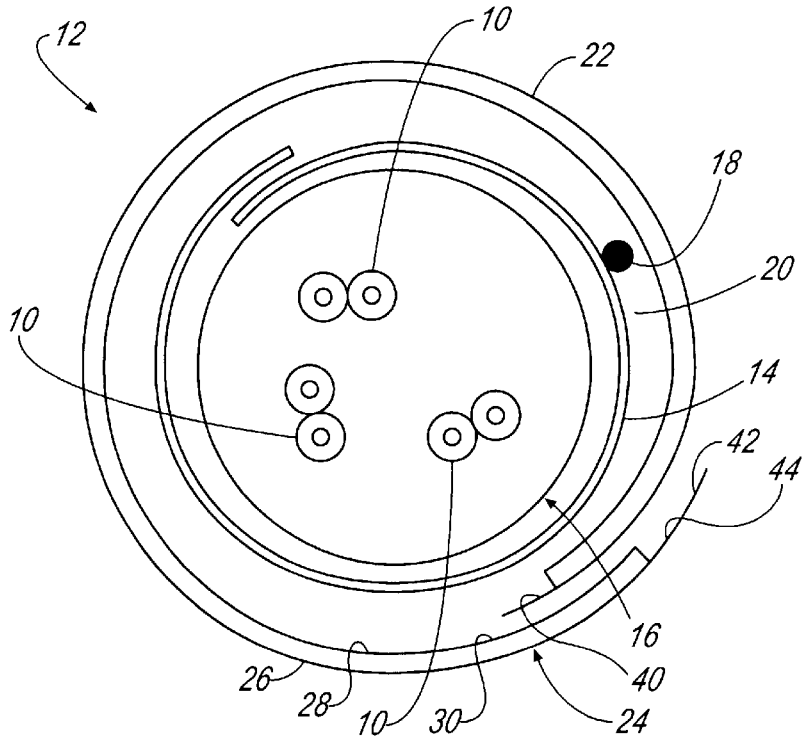
FIG. 1 is a cross sectional view of a binder unit constructed according to the present invention.

With reference to FIG. 1, a plurality of twisted wire pairs 10 comprise a binder unit 12 for inclusion into a transport cable. Under the present invention, the number of twisted wire pairs 10 is predetermined by the manufacturer of the binder unit 12, but in practice it has been found that 25 pairs of #24 AWG insulated copper wires may easily be combined into a single binder unit 12. The twisted wire pairs 10 are bundled together and wrapped with a standard unit wrap 14 to form a bound core 16 of the binder unit 12. The unit wrap 14 may comprise a polyester film, or other material known in the art. Preferably, the unit wrap 14 comprises a 2 mil thick polyester film of the type well known in the art. A unit drain wire 18 is placed adjacent the exterior 20 of the unit wrap 14, and is then wrapped in a binder unit shield 22. Preferably, after placement of the unit drain wire 18, a foil free edge tape 24 is helically wound about the bound core 16 and the unit drain wire 18. If the foil free edge tape 24 is helically wound about the bound core 16, then the unit wrap 14 is also applied in a helical fashion.

Figure 3:
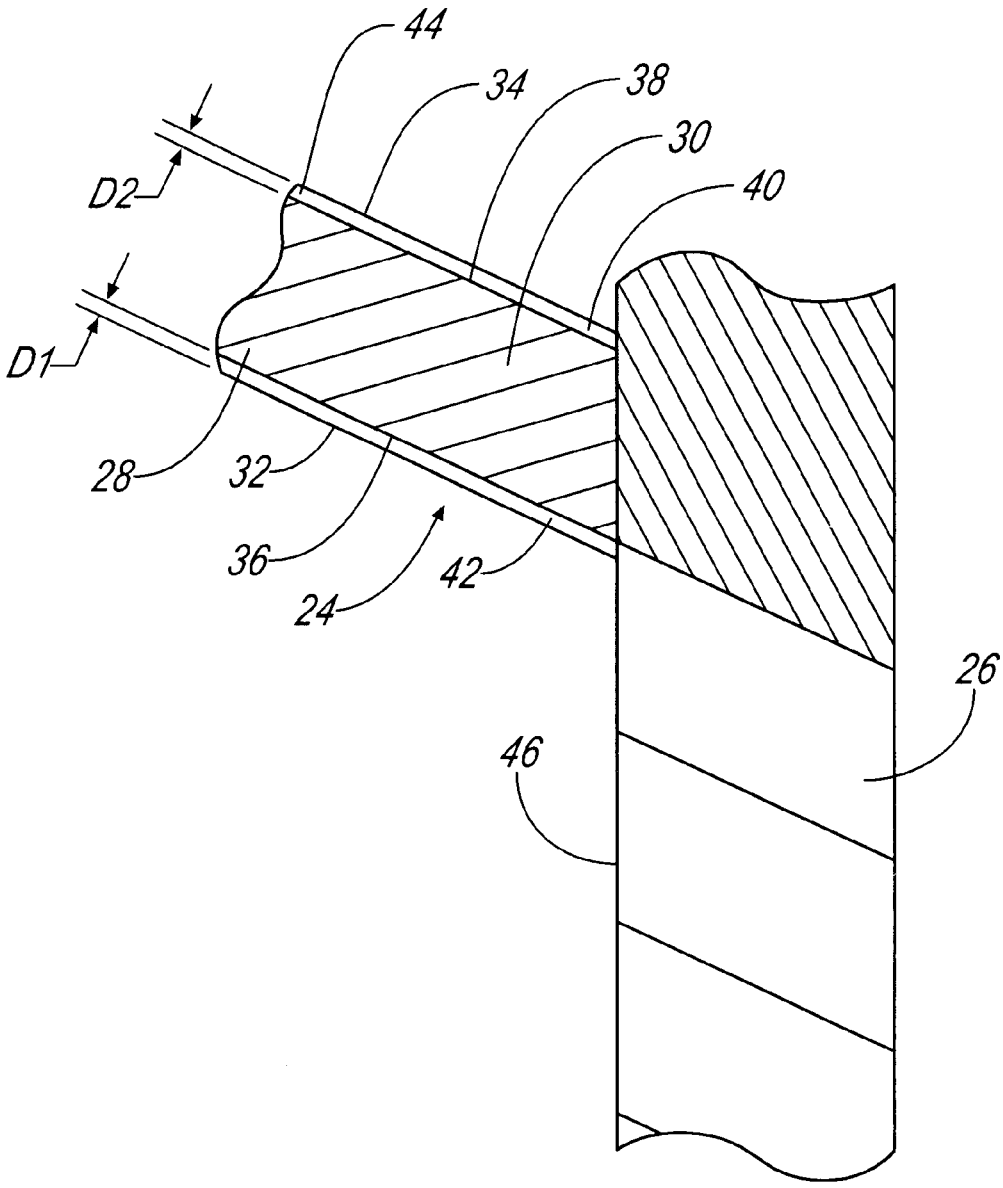
FIG. 3 is a perspective view of a shield tape according to the present invention.

As shown in FIGS. 1 and 3, the foil free edge tape 24 includes two surfaces. An outer surface 26 of the tape 24 is an exposed non-conductive material such as an appropriate polymer or plasticized material of the type well-known in the art. An inner surface 28 of the tape 24 includes a conductive foil surface 30. The foil surface 30 extends the full longitudinal length of the tape 24 and is of a predetermined thickness, but preferably extends less than the full width of the tape 24, making the longitudinal edges of the tape "foil free." In one embodiment, a portion of the non-conductive material remains exposed on the inner surface 28 of the tape 24 adjacent the foil surface 30. Preferably, the exposed non-conductive material is coated with an adhesive of the type known in the art. As best seen in FIG. 3, the foil surface 30 of the inner surface 28 of the tape 24 is most preferably centered between the longitudinal sides 32, 34 of the tape 24 such that exposed portions 40, 42 remain between the longitudinal sides 32, 34 of the tape 24 and the respective longitudinal sides 36, 38 of the foil surface 30. Distances D1 and D2 define the extent of the foil free edge of the tape 24. In the most preferred embodiment, the distances D1 and D2, measured between respective tape longitudinal sides 32, 34 and foil surface longitudinal sides 36, 38, are identical, but they need not be. As in a previous embodiment, the exposed portions 40, 42 are coated with an adhesive 44 capable of forming a bond between a respective exposed portion 40, 42 and the outer surface 26 of the tape 24.

When the foil free edge tape 24 is helically wound about the bound core 16 and the unit drain wire 18, the helical spacing of the foil free edge tape is such that the first longitudinal side 36 of the foil surface 30 is wound substantially adjacent the second longitudinal side 38 of the foil surface 30 on successive winds. As seen in FIG. 1, the foil surface may even overlap slightly about the circumference of the bound core 16. However, the leading edge exposed tape portion 40, including the adhesive 44, contacts the exterior surface 20 of the unit wrap 14, while the trailing-edge exposed tape portion 42, including the adhesive 44, contacts the outer surface 26 of the tape 24 of the preceding wind. In this way, the tape 24 is secured both to the unit wrap 14 and to adjacent winds of the tape, thereby preventing migration of the tape or gaps between successive winds when the binder unit 12 is flexed or moved. Moreover, because the tape portions 40, 42 do not include foil, no part of the foil surface 30 is exposed on the exterior 46 of the shield tape.

Figure 4:
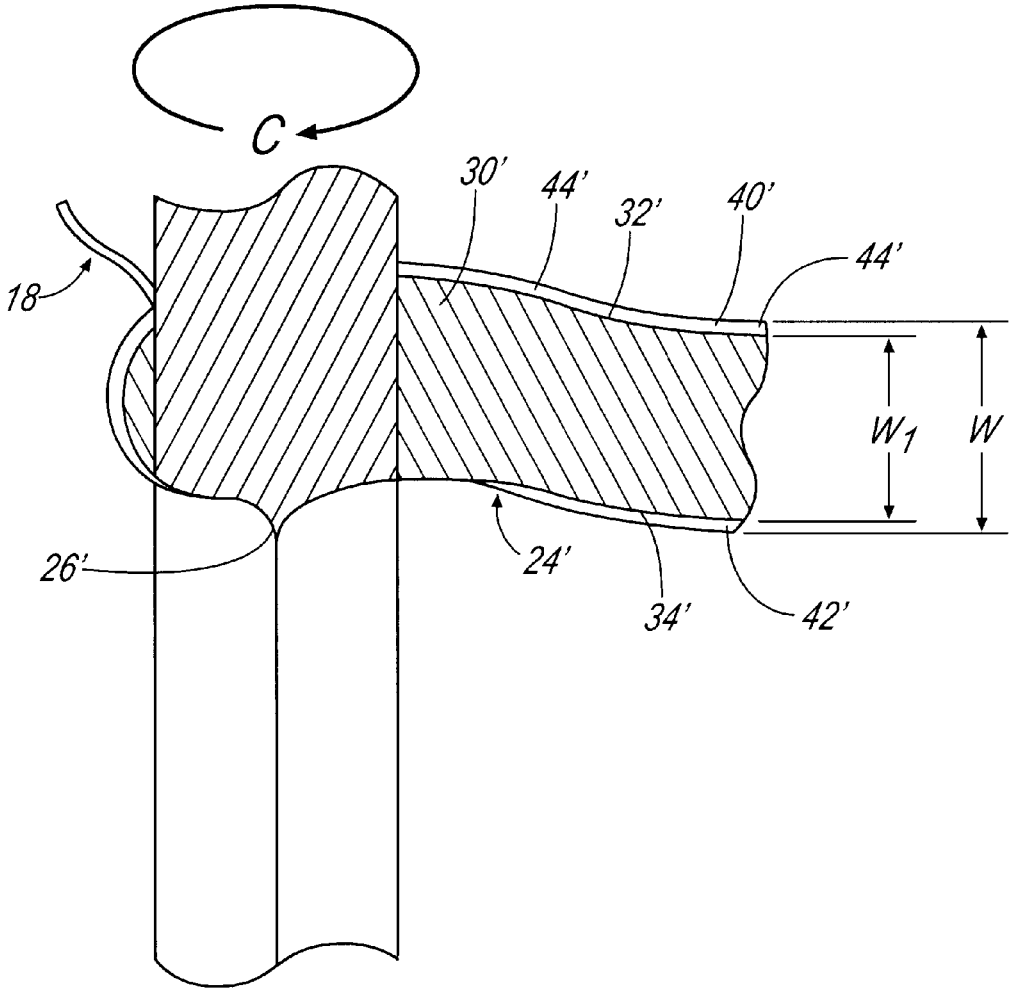
FIG. 4 is a perspective view of an alternative shield tape configuration according to the present invention.

In another embodiment, shown in FIG. 4, the tape 24' may be formed of a single long strip of polymeric material having a width W that is slightly larger than the circumference C of the exterior surface 20 of the unit wrap 14. The foil surface 30' of the tape 24' has a width W1 that is substantially equal to the circumference C of the exterior surface 20 of the unit wrap 14 while accommodating the insertion of the drain wire 18. The remaining width (W−W1) of the inner surface 28' of the tape 24' defines an exposed portion 40' that includes an adhesive 44'. Instead of being helically wound about the exterior of the unit wrap 14 and the unit drain wire 18, the width W of tape 24' is wrapped circumferentially about the binder unit 12 and the drain wire 18 such that first and second longitudinal surfaces 32', 34' meet along the axial length of the binder unit 12. In this embodiment, if the tape 24' is wrapped circumferencially about the binder unit 12, then the unit wrap 14' is comprised of an elongated strip of polyester film that is wrapped circumferentially along the longitudinal length of the twisted pairs.

The exposed portion 40', including the adhesive 44', then overlaps a portion of the tape outer surface 26', thereby sealing the core wrap within the tape 24. As shown in FIG. 4, the inner surface 28' of the tape 24' may include opposing exposed portions 42', 44' including an adhesive so that one longitudinal edge of the tape 24' may be affixed to the outer surface 20 of the unit wrap 14 if desired. In this way, none of the foil surface 30 remains exposed on the exterior of the completed binder unit 12.

Figure 2:
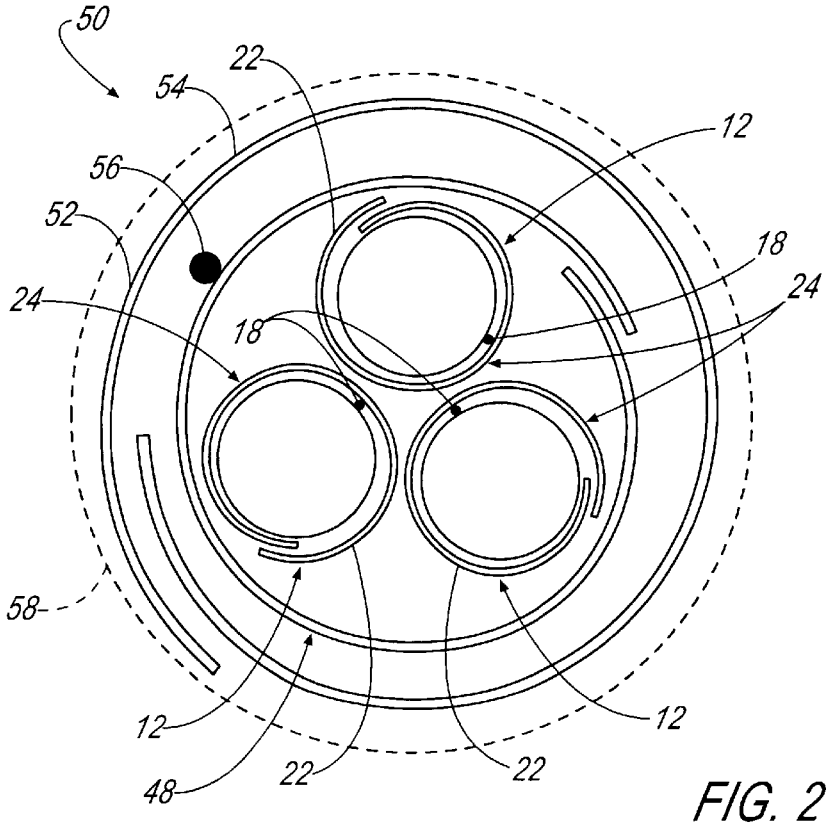
FIG. 2 is a cross sectional view of a cable constructed according to the present invention.

A cable 50 formed from multiple binder units 12 is shown in FIG. 2. In FIG. 2, only three binder units are combined to form bound core 48 of the cable 50, but it should be understood that the number of binder units 12 to be combined in a single cable 50 is limited only by spatial constraints and convenience. Each binder unit is constructed as described above, and is placed within a cable having an overall shield 52 that encircles the bound core 48 and all of the binder units 12. To ensure that no electrical interaction occurs between the overall shield 52 and the shield 22 of each binder unit 12, an outer core wrap 54 is formed about the exterior of the combined bound core 48 using conventionally available methods and materials, such as a polyester film similar to the unit wrap 14, or other materials. The cable 50 will be subject to flex over time, which may open gaps in the tape 24 of each binder unit 12. Without the outer core wrap 54, tape gaps would potentially cause contact between the overall shield 52 and the shield 22 of each binder unit 12 over time as the cable 50 is flexed. Thus, the outer core wrap 54 is an added precaution to enhance isolation of each binder unit 12. An overall shield drain wire 56 is placed between the outer core wrap 54 and the overall shield 52. In one embodiment, the overall shield 52 is a conventionally available foil shield. In another embodiment, the overall shield 52 is a braided shield of the type conventionally known. However, in the preferred embodiment, the overall shield 52 is comprised of a combination foil and braid to provide the greatest amount of shielding. Finally, a conventional cable jacket or sheath 58 is applied over the entire length of the cable 50.

Figure 5:
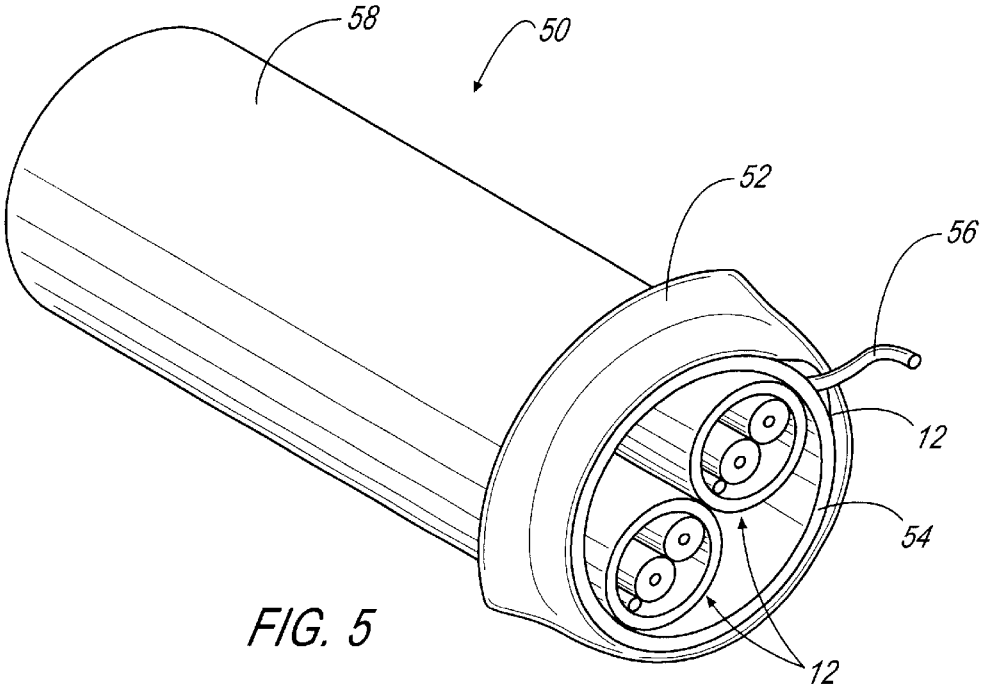
FIG. 5 is a perspective view of the cable of FIG. 2 with terminating the overall shield according to a method of the present invention.

Referring now to FIG. 5, because the overall shield 52 is isolated from the unit shields 22, the overall shield 52 may be terminated to ground independently of the individual unit shields 22, thereby protecting the inner binder units 12 from outside interference, for example, from other adjacent cables. Moreover, the overall shield 52 is preferably applied with the foil side in facing contact with the outer surface of the outer core wrap 54. This arrangement allows the foil to be folded back over the jacket 58 and terminated using a simple grounding clamp, rather than by grounding the drain wire as is currently the practice. By clamping the overall shield 52 instead of the drain wire 56, shielding performance is enhanced because the drain wire 56 is not able to act as an antenna and draw interference into the cable. Similarly, the foil surface 30 of the foil free edge tape 24 applied to each binder unit 12 is separated from the twisted pairs 10 by the unit wrap 14. The unit wrap 14 offers the benefits of isolating the twisted pair conductors from the foil surface 30, thereby preventing shorts or signal loss through pinholes in the twisted pair insulation.

Figure 6:
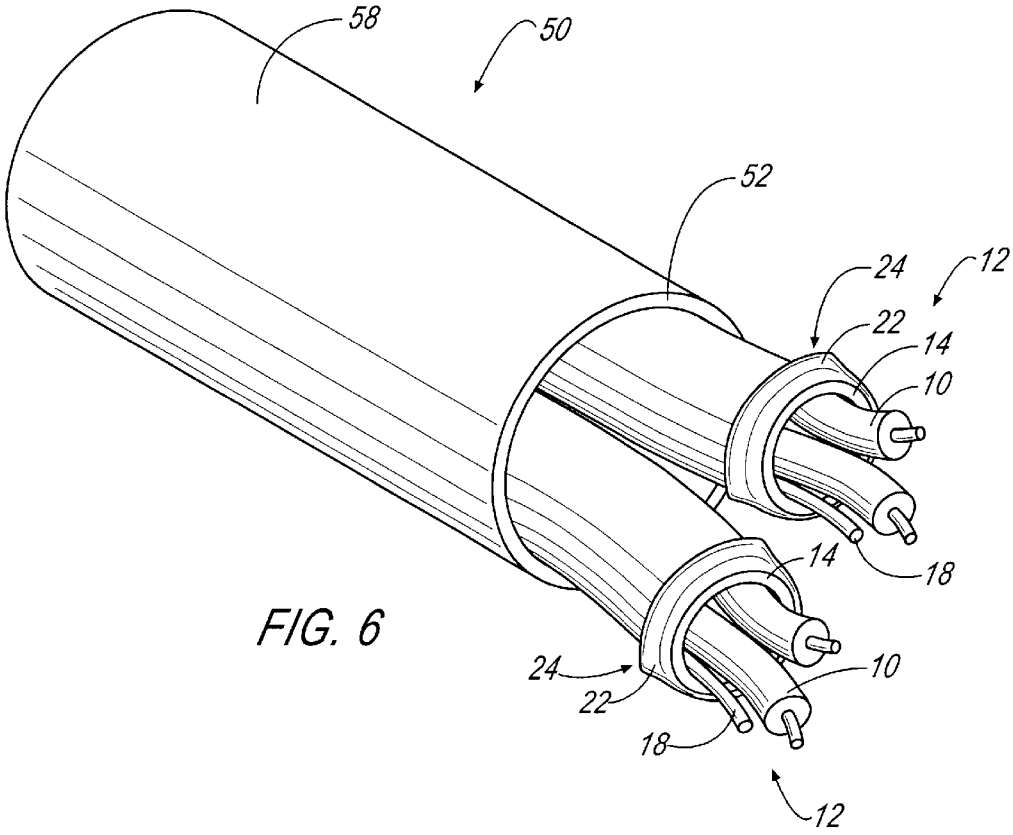
FIG. 6 is a perspecitve view of the cable of FIG. 2 with terminating the binder unit shield according to a method of the present invention.

Like the overall shield 52, each binder unit shield 22 may be terminated independently to ground, thereby providing protection against binder unit to binder unit crosstalk within the cable, as shown in FIG. 6. In fact, because of the foil free edge tape arrangement, only a minimal amount of shield 22 need be removed for termination. In practice, when an installer or end user is attaching the cable to various contact points, including to ground, the installer may optionally apply a separate appropriately sized tube of a known, shrink-wrap material, around the outside of each binder unit 12. However, a short length, on the order of two to three inches, of the binder unit is left exposed by the installer on each end of the binder unit 12. The foil free edge tape 24 is then stripped back to the edge of the tube and is terminated using a grounding clamp or by clamping a connector over the shield, as for example, a 50-pin connector ground. The shrink wrap tube prevents further unwinding of the foil free edge tape 24, and ensures that the cable of the present invention retains its intended dimensional shape. The twisted pairs within the unit may then be connected conventionally to either a termination point, such as a punch-down block, or to the 50-pin connector. In either case, only a minimal amount of each twisted pair is exposed outside of the shield. Because the twisted pairs are surrounded by the unit wrap 14, the shield 22 is isolated from the twisted pairs 10, minimizing the impedance mismatch between the minimally exposed end portions of each twisted pair 10 and the unexposed portions of the twisted pairs. Finally, application of the outermost shrink wrap tube over the shield 22 stabilizes the binder unit, preventing distortion of the binder unit 12 under flex or torsional forces.

Using the cable 50 manufactured according to the present invention, separate digital services may be provided through each of the binder units based upon the frequency spectrum within which they operate. Alternatively, one binder unit may be used as a "send" unit, while an adjacent binder unit may be designated the "receive" units. By separating "send" and "receive" functions between binder units, rather than simply between twisted pairs within a single unit, local crosstalk is minimized, leading to increased transmission distances.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications will come within the teachings of this invention and that such modifications are within its spirit and the scope as defined by the claims.

What is claimed is:

1. A method for minimizing crosstalk within a telecommunications cable, comprising the steps of:

wrapping a plurality of twisted wire pairs with a unit wrap;

placing a unit drain wire adjacent an outer surface of the unit wrap;

wrapping the unit wrap and the unit drain wire with a binder unit shield to form a binder unit;

wrapping one or more the binder units with an outer core wrap;

placing an overall shield drain wire adjacent an outer surface of the outer core wrap;

enclosing the one or more wrapped binder units and the overall shield drain wire with an overall shield having an inner surface of conductive material contacting the outer surface of the outer core wrap and the overall shield drain wire;

enclosing the overall shield with a jacket; and grounding the cable by folding the overall shield back over the jacket, thereby minimizing crosstalk within the telecommunications cable.

2. The method according to claim 1, wherein the binder unit shield comprises a foil free edge tape having an inner surface of conductive material and an outer surface of non-conductive material, the inner surface of conductive material contacting an outer surface of the unit wrap and the unit drain wire.

3. The method according to claim 2, further comprising the step of grounding each binder unit shield, thereby minimizing binder unit to binder unit crosstalk within the telecommunications cable.

4. The method according to claim 2, wherein the foil free edge tape is helically wrapped around the unit wrap and the drain wire.

5. The method according to claim 2, wherein the foil free edge tape is circumferentially wrapped around the unit wrap and the drain wire.

6. A method for minimizing crosstalk within a telecommunications cable, comprising the steps of:

wrapping a plurality of twisted wire pairs with a unit wrap;

placing a unit drain wire adjacent an outer surface of the unit wrap;

wrapping the unit wrap and a drain wire with a binder unit shield comprising a foil free edge tape having an inner surface of conductive material and an outer surface of non-conductive material to form a binder unit;

wrapping the one or more binder units with an outer core wrap;

placing an overall shield drain wire adjacent an outer surface of the outer core wrap;

enclosing the one or more wrapped binder units and the overall shield drain wire with an overall shield;

enclosing the overall shield with a jacket; and grounding each binder unit shield, thereby minimizing binder unit to binder unit crosstalk within the cable.

7. The method according to claim 6, wherein the overall shield has an inner surface of conductive material contacting an outer surface of the outer core wrap and the overall shield drain wire.

8. The method according to claim 7, further comprising the step of grounding the cable by folding the overall shield back over the jacket, thereby enhancing shielding performance of the cable.

9. The method according to claim 6, wherein the foil free edge tape is helically wrapped around the unit wrap and the drain wire.

10. The method according to claim 6, wherein the foil free edge tape is circumferentially wrapped around the unit wrap and the drain wire.

* * * * *